US009255496B2

(12) United States Patent
Zeidler

(10) Patent No.: US 9,255,496 B2
(45) Date of Patent: Feb. 9, 2016

(54) VALVE TRAIN OF AN INTERNAL COMBUSTION ENGINE, AN INTERNAL COMBUSTION ENGINE, AND A METHOD FOR PRODUCING A CORRESPONDING VALVE TRAIN

(75) Inventor: Rüdiger Zeidler, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 14/236,553

(22) PCT Filed: Aug. 1, 2012

(86) PCT No.: PCT/EP2012/003265

§ 371 (c)(1),
(2), (4) Date: Jan. 31, 2014

(87) PCT Pub. No.: WO2013/017270

PCT Pub. Date: Feb. 7, 2013

(65) Prior Publication Data

US 2014/0174389 A1 Jun. 26, 2014

(30) Foreign Application Priority Data

Aug. 2, 2011 (DE) ..... 10 2011 109 256

(51) Int. Cl.

| | |
|---|---|
| ***F01L 1/34*** | (2006.01) |
| ***F01L 1/04*** | (2006.01) |
| ***F01L 1/053*** | (2006.01) |
| ***F01L 13/00*** | (2006.01) |

(52) U.S. Cl.

CPC . *F01L 1/04* (2013.01); *F01L 1/053* (2013.01); *F01L 13/0036* (2013.01); *F01L 13/0042* (2013.01); *Y10T 29/49293* (2015.01)

(58) Field of Classification Search

USPC ..... 123/90.15, 90.17, 90.6, 90.18; 29/888.1; 74/567

See application file for complete search history.

(56) References Cited

U.S. PATENT DOCUMENTS

| | | | | |
|---|---|---|---|---|
| 8,746,194 | B2 * | 6/2014 | Werler et al. | 123/90.18 |
| 2007/0204819 | A1 | 9/2007 | Elendt et al. | |
| 2009/0064952 | A1 * | 3/2009 | Wutzler | 123/90.18 |

FOREIGN PATENT DOCUMENTS

| | | |
|---|---|---|
| DE | 101 21 798 | 11/2002 |
| DE | 102004002301 | 8/2005 |

(Continued)

OTHER PUBLICATIONS

International Search Report issued by the European Patent Office in International Application PCT/EP2012/003265 on Nov. 9, 2012.

(Continued)

*Primary Examiner* — Jesse Bogue
*Assistant Examiner* — Daniel Bernstein
(74) *Attorney, Agent, or Firm* — Henry M. Feiereisen LLC

(57) ABSTRACT

A valve train of an internal combustion engine includes at least one basic camshaft with a cam carrier provided thereupon in a rotationally fixed and axially displaceable manner. The cam carrier has at least one valve-actuating cam as well as a tubular basic element that receives the basic camshaft in at least some sections. At least one cam element of the cam carrier, in particular the valve-actuating cam, is arranged on the basic element. At least one torque-transmitting connecting element is located between the basic element and the cam element. An internal combustion engine having at least one valve train and a method for producing a valve train are also disclosed.

13 Claims, 4 Drawing Sheets

(56) References Cited

FOREIGN PATENT DOCUMENTS

| | | | |
|---|---|---|---|
| DE | 102009022657 | | 1/2011 |
| DE | 102009037270 | A1 * | 3/2011 |
| DE | 102009048621 | | 4/2011 |
| DE | 102010004591 | | 7/2011 |
| WO | WO 2006/012959 | | 2/2006 |

OTHER PUBLICATIONS

K.-H. Decker: Maschinenelemente: Gestaltung und Berechnung, 8th edition, München, Carl Hanser Publishers, 1982, pp. 183-187.

* cited by examiner

VALVE TRAIN OF AN INTERNAL COMBUSTION ENGINE, AN INTERNAL COMBUSTION ENGINE, AND A METHOD FOR PRODUCING A CORRESPONDING VALVE TRAIN

CROSS-REFERENCES TO RELATED APPLICATIONS

This application is the U.S. National Stage of International Application No. PCT/EP2012/003265, filed Aug. 1, 2012, which designated the United States and has been published as International Publication No. WO 2013/017270 and which claims the priority of German Patent Application, Ser. No. 10 2011 109 256.4, filed Aug. 2, 2011, pursuant to 35 U.S.C. 119(a)-(d).

BACKGROUND OF THE INVENTION.

The invention relates to a valve train of an internal combustion engine, having at least one basic camshaft on which a cam carrier having at least one valve-actuating cam is disposed in a rotationally fixed and axially displaceable manner, wherein the cam carrier has a tubular basic element which at least partially accommodates the basic camshaft, on which basic element at least one cam element of the cam carrier, in particular the valve-operating cam, is arranged. The invention furthermore relates to an internal combustion engine and a method of manufacturing a valve train.

Valve trains of the aforementioned type are known in the art. They are used for internal combustion engines, where the operating cycle of gas-exchange valves of individual cylinders of the internal combustion engine can be controlled to improve the thermodynamic property. The at least one cam carrier, which can also be referred to as a cam piece, is arranged on the basic camshaft in a rotationally fixed and axially displaceable manner. The cam carrier is displaced in the axial direction by an adjusting device, which includes a shift gate on the cam carrier and a fixedly arranged actuator, typically in a cylinder head of the internal combustion engine. The actuator has an extendable follower which can be brought into engagement with a helical or spiral groove of the shift gate. At least one valve-actuating cam having an eccentricity, which serves to actuate a gas exchange valve of internal combustion engine at a certain rotational angle of the basic camshaft, is associated with the cam carrier. The valve-actuating cam therefore rotates together with the basic camshaft, so that the gas-exchange valve of the internal combustion engine is operated at least once per revolution of the valve-actuating cam or its eccentricity. The valve-actuating cam preferably cooperates with a roller cam follower of the gas exchange valve by making direct contact therewith.

Preferably, several valve-actuating cams are provided which may be associated with different cam groups. The valve-actuating cams can now vary in the angular position, in the extent in a radial direction and/or in the eccentricity in the circumferential direction. By way of the axial displacement of the cam carrier, the cam carrier can be brought into at least two, for example, in a first and a second actuating position. In the first actuating position, the gas exchange valve is actuated by a first of the valve-actuating cams and in the second actuating position by a second of the valve-actuating cams that are assigned to the same cam group. By the displacement of the cam carrier, in particular the opening timing, the opening duration and/or the stroke of the gas change valve can be selected, in particular as a function of an operating state of the internal combustion engine.

Conventional cam carriers are integrally formed and are made of a metallic solid material, which is subjected to various manufacturing steps. The manufacturing steps include, for example, reaming an internal toothing of the cam support, grinding or turning cylindrical portions of the cam carrier used for rotational support, electron-beam hardening of a surface of the valve-actuating cam as well as gas nitration of surfaces in the area of the shift gate. These manufacturing steps require a not inconsiderable effort and associated costs. In addition, split bearings with two bearing shells or bearing shell halves are required for supporting the conventional cam carriers in the cylinder head of the internal combustion engine which results, on the one hand, in additional manufacturing and assembly costs and causes, on the other hand, increased friction losses in the event of an imperfect pairing of the two bearing shells or bearing shell halves.

To reduce the manufacturing complexity, the cam carrier may have a modular design and may be composed of the basic element and the at least one cam element. The basic element is essentially tubular and at least partially receives the basic camshaft. For this purpose, it encompasses the basic camshaft in the circumferential direction at least partially, preferably completely. The basic element preferably has an internal toothing which engages with an external toothing of the basic camshaft for holding the basic element on the basic camshaft in a rotationally fixed manner. The basic element can be completely drawn together with the internal toothing as a profile and can thus be easily and inexpensively produced. The at least one cam element is arranged on the basic element. The cam element is in particular formed as a cam disc. For example, the valve-actuating cam is embodied as a cam element. However, the cam element may alternatively also be another element, such as the shift gate, a spacer or a locking element. The cam element is preferably made of bearing steel, which is (fine-) punched and ground or reamed on its inner side. Identical or similar cam elements can be ground or reamed together, which allows for an efficient and economical production.

For example, DE 10 2009 022 657 A1 discloses a camshaft for an internal combustion engine. This camshaft consists of a basic shaft having at least one external toothing, and at least one cam carrier which is axially displaceably mounted on the basic shaft and has at least one inner toothing co-operating with the external toothing. The external toothing or the internal toothing is to be made of plastic, wherein the cam carrier made of plastic is molded around the cam elements. Therefore, a modular construction of the cam carrier and the cam elements is already described to some extent. However, the production cost is very high.

SUMMARY OF THE INVENTION

It is therefore an object of the invention to provide a valve train of an internal combustion engine, which obviates the afore-mentioned disadvantages and which can in particular be easily and inexpensively produced and which has at the same time good long-term durability.

This is achieved by the invention with a valve train of an internal combustion engine having at least one basic camshaft on which a cam carrier having at least one valve-actuating cam is arranged in a rotationally fixed and axially displaceable manner. The cam carrier includes a tubular basic element that at least partially accommodates the basic camshaft and on which at least one cam element of the cam carrier, in particular the valve-actuating cam, is disposed. It is hereby provided that at least one torque-transmitting connecting element is disposed between the basic element and the cam element. Unlike in the prior art, the cam carrier is hereby not molded around the cam element, thereby fixing the cam element to the cam carrier. Instead, the connecting element should be disposed between the basic element and the cam element arranged on the basic element, which locks the cam element at least in the circumferential direction relative to the basic element, thereby ensuring a reliable torque transfer from the basic element to the cam element. The connecting element is preferably a sintered element which is hardened or cured. The valve train according to the invention has advantageously a modular design, so that its individual components, i.e. the basic camshaft and the cam carrier or basic element as well as the cam element can be made of a material selected according to the respective load. Material-specific production methods can also be selected for the production. The most advantageous material can therefore be used for each of the elements of the valve train. The modular nature of the valve train is particularly advantageous in one embodiment where the cam element can be fitted onto the basic element.

According to a refinement of the invention, the connecting element at least partially engages in a retaining opening of the basic element and is positively held in the retaining opening at least in the circumferential direction, in particular additionally in the axial direction. The basic element therefore has the retaining opening, which is preferably disposed in a jacket or a jacket surface of the tubular element or extends through the jacket surface. The connecting element then engages at least in sections in the retaining opening, wherein the shapes of the connecting element and the retaining opening are matched such that the connecting element is at least form-fittingly held in the circumferential direction. The retaining opening is preferably formed as a slot extending in the axial direction. Preferably, the connecting element is also held stationary and form-fittingly in the retaining opening in the axial direction. However, the retaining opening may allow to some extent a displacement of the connecting element in the axial direction. In particular, only one retaining portion of the connecting element may be arranged in the retaining opening, while a supporting region of the connecting element rests on a wall of the basic element, in particular the jacket or the jacket surface lies and protrudes in the radial direction over the basic element. At least the supporting region may substantially have the shape of a cuboid. In particular, the shape of the side of the supporting region facing the basic element is matched to that of the basic element so that it substantially rests flat on the basic element. Due to the cooperation of the retaining opening and the connecting element, the connecting element is affixed on the basic element with a rotation lock with respect to an axis of rotation of the basic camshaft.

According to a refinement of the invention, the connecting element engages at least partially in a locating opening of the cam element and is fixedly supported therein in the circumferential direction, while being movable especially in the axial direction. The shape of the locating opening as well as of the retaining opening of the basic element is therefore matched to the shape of the connecting element so as to realize positive retention of the cam element in the circumferential direction. The connecting element is therefore non-rotatably connected to the basic element via the cam element. However, the cam element may be movable in the axial direction in spite of the stationary support in the circumferential direction. This is achieved in particular by having the retaining opening pass completely through the cam element in the axial direction. This allows the cam element to be attached during assembly of the valve train. The cam element can thus be pushed onto the cam carrier. As already explained above, the connecting element is advantageously composed of the holding portion and a support portion. Whereas the holding portion engages in the retaining opening of the basic element, the support portion should at least partially engage in the locating opening of the cam element. Thus, the connecting element engages both in the basic element and the cam element in the radial direction.

According to a refinement of the invention, a plurality of cam elements may be provided, which are secured in the axial direction by abutting contact with adjacent cam elements. It is therefore not intended that the individual cam elements are fastened on the basic element in the axial direction by separate fastening means. Instead, they should be arranged in relation to each other that they are immovable in the axial direction. For this purpose, cam elements arranged at the end of the cam carrier or the basic element are designed, for example, as locking elements. The locking elements are held stationary relative to the basic element in the axial direction, whereby the other cam elements are also held stationary in the axial direction. The locking element is, for example, a hardened sintered element.

According to a refinement of the invention, as viewed in the circumferential direction, the basic element may have only a single retaining opening and/or the cam element may have only a single locating opening. Accordingly, several retaining openings or several locating openings are no longer arranged side by side in the circumferential direction. If several retaining openings or locating openings are present, then these are offset in the axial direction and preferably spaced apart from one another. Alternatively, of course, several retaining holes or locating openings, each with a connecting element disposed therein, may also be provided in the circumferential direction. Preferably, the retaining openings and locating openings are in this case uniformly distributed over the circumference of the basic element or the cam element. In particular, in each case two respective retaining openings or two respective locating openings face each other diametrically.

According to a refinement of the invention, the connecting element commonly forms at least one retaining device for axially securing the cam carrier with respect to the basic camshaft, in particular by having the retaining opening pass completely through a wall of the basic element in the radial direction. The retaining device is used to hold the cam carrier in the axial direction relative to the basic camshaft. However, the axial securement need not be permanent. For example, the retaining device may allow an axial displacement between at least two axial positions. In this case, the retaining device may be particularly designed such that a sufficiently large force must be applied in the axial direction on the cam carrier for exiting one of the axial. positions. The cam carrier moves out of its momentary axial position and enters the adjacent axial: position only upon application of this force. In principle, any number of such axial positions may be provided. However, conventional designs of the valve train have only two or three axial positions.

The retaining device may in particular be designed as a latching device, wherein a latching element may be provided in a radial recess of the basic camshaft. The latching element may be, for example, elastic or spring-biased by a spring element, so that it is urged in the direction of the connecting element. The connecting element has at least one latching recess into which the latching element can latch. Here, a number of latching recesses corresponding to the desired number of axial positions of the cam carrier may be provided which are spaced from each other on the connecting element in the axial direction. The cam carrier can thus be shifted in the axial direction with respect to the basic camshaft, wherein the latching force of the latching device must be overcome during each shift. When no force is applied or when the applied force is smaller than the latching force of the latching device, the cam carrier remains and is reliably secured in its present axial position. For this purpose, the retaining opening completely passes through the wall of the basic element in the radial direction so that the latching element is able to latchingly engage the connecting element through the retaining opening.

According to a refinement of the invention, a plurality of connecting elements may be provided which are spaced apart relative to one another in the axial direction, in particular at the same circumferential position, wherein a camshaft bearing, in particular an undivided bearing seat of the camshaft bearing, is directly seated on the basic element between any two of the connecting elements. The camshaft bearing or its bearing shell does not have a locating opening like the cam element. Instead, these are seated directly on the basic element and preferably over their entire area. This means that the camshaft bearing or the bearing shell is in abutting contact with the basic element. In this way, the bearing forces are uniformly applied to the basic element or the camshaft bearing. The camshaft bearing or the bearing shell is enclosed in the axial direction by the connecting elements or is at least arranged adjacent to a connecting element. The connecting elements and/or the cam elements arranged thereon may come into abutting contact with the camshaft bearing, thereby securing the camshaft bearing in the axial direction relative to the basic element. Advantageously, the connecting elements may be arranged on the basic element at the same circumferential position. However, the connecting elements may also have different, in particular varying, circumferential positions.

According to a refinement of the invention, the camshaft bearing is held stationary in the axial direction by adjacent connecting elements and/or cam elements. As already stated above, connecting elements are preferably provided on both sides of the camshaft bearing. These connecting elements provide a rotationally fixed arrangement of the cam elements on the basic element. The connecting elements or the cam elements should now be arranged with respect to the camshaft bearing so as to hold the camshaft bearing stationary in the axial direction, in particular through abutting contact. The connecting elements and/or the cam elements hence abut the camshaft bearing in the axial direction such that the camshaft bearing is immovable in the axial direction.

The invention further relates to an internal combustion engine with at least one valve train, in particular according to the above embodiments, which has at least one basic camshaft on which at least one cam carrier having valve-actuating cams is arranged in a rotationally fixed and axially displaceable manner, wherein the cam carrier has a tubular basic element which at least partially receives the basic camshaft and on which at least one cam element of the cam carrier, in particular the valve-operating cam, is arranged. At least one torque-transmitting connecting element is disposed between the basic element and the cam element. The valve train may be further improved according to the above description. In principle, it should be emphasized again that the valve train may include any number of cam carriers, which are arranged axially displaceable on the basic camshaft. Each cam carrier has preferably a plurality of cam elements, wherein two of the cam elements may be locking elements and another of the cam elements may be present a shift gate. The additional cam elements are in particular designed as valve-actuating cams.

The invention further relates to a method of manufacturing a valve train, preferably in accordance with the foregoing description, whereby the following steps are performed: providing a basic element, forming at least one retaining opening in the basic element, inserting a torque-transmitting connecting element in the retaining opening, and pushing at least one cam element, in particular a valve-actuating cam, over the connecting element. The retaining opening is preferably formed so as to completely pass through a wall or a jacket of the basic element, which is substantially tubular. The valve train is essentially constructed in accordance with the above description.

BRIEF DESCRIPTION OF THE DRAWING

The invention will now be explained in more detail with reference to the exemplary embodiments illustrated in the drawings, without limiting the scope of the invention. In the drawing show in.

DETAILED DESCRIPTION OF PREFERRED EMBODIMENTS

Figure 1:
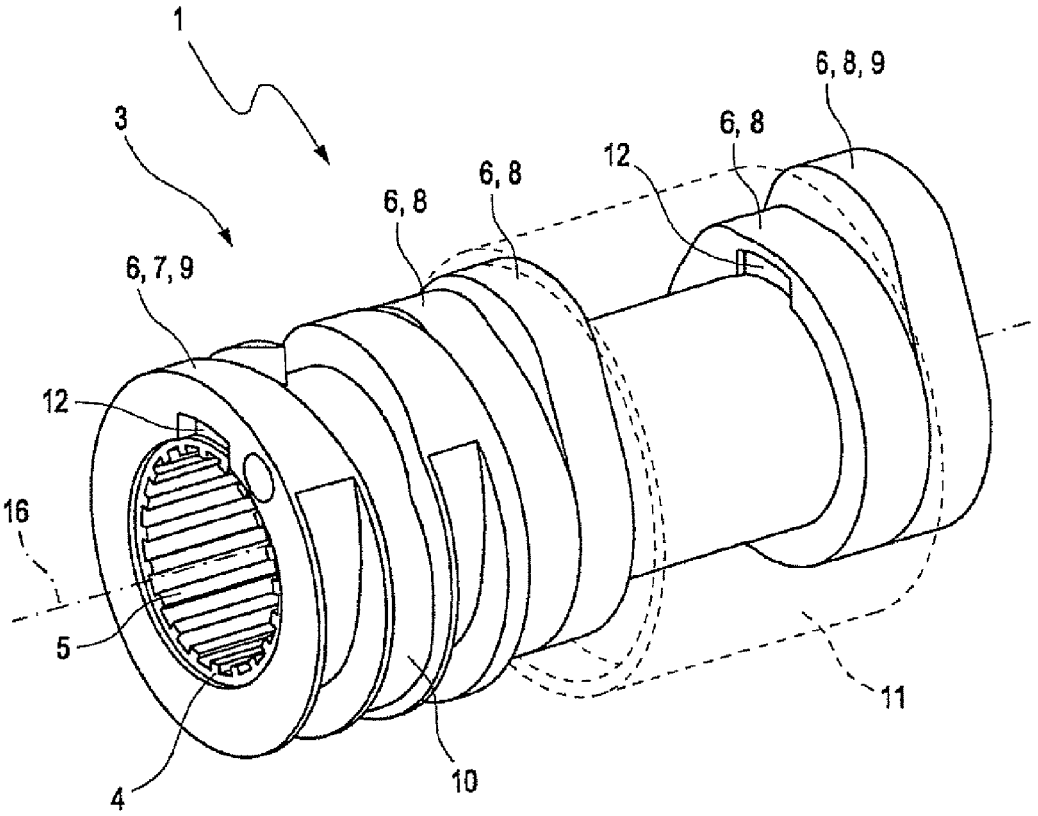
FIG. 1 a diagram of a portion of a valve train of an internal combustion engine, showing a cam carrier composed of a basic element, on which at least one cam element of the cam carrier is arranged, FIG. 2 a side sectional view of a portion of the valve train in a first embodiment, FIG. 3 a side sectional view of the valve train in a second embodiment, FIG. 4 the basic element of the cam carrier, FIG. 5 two connecting elements which can be inserted into a retaining opening of the basic element, FIG. 6 an exploded view of a portion of the valve train, showing the basic element, the connecting elements, several cam elements and a camshaft bearing, and FIG. 7 the portion of the valve train known from FIG. 6, fully assembled.

FIG. 1 shows a portion of a valve train 1 of an unillustrated internal combustion engine. The valve train 1 is composed of an unillustrated basic camshaft 2 and a cam carrier 3 which is axially displaceable thereon. The cam carrier 3 is composed of a basic element 4 which is substantially tubular and which at least partially accommodates the basic camshaft 2. Here, the basic element 4 has an internal toothing 5, which cooperates with an external toothing of the basic camshaft 2 so as to hold the cam carrier 3 on the basic camshaft 2 in a rotationally fixed and axially displaceable manner. The cam carrier 3 has several cam elements 6 in addition to the basic element 4. One of the cam elements 6 is designed as a shift gate 7 and others of the cam elements 6 are designed as valve-actuating cams 8. The cam elements 6 disposed on the ends of the cam carrier 3 may operate at the same time as locking elements 9.

The shift gate 7 is part of an unillustrated actuating device, with which the cam carrier 3 can be displaced on the basic camshaft 2 in the axial direction. For this purpose, the shift gate 7 has a groove 10 which has at least partially a helical shape and with which an actuator of the actuating device cooperates. For this purpose, the actuator has, for example, an extendable tappet adapted for engagement with the groove 10 of the shift gate 7. This engagement causes a displacement of the cam carrier 3 in one or the other direction in the axial direction based on a current axial position of the cam carder 3 with respect to the basic camshaft 2.

The valve-actuating cams 8 serve to operate unillustrated gas exchange valves. To this end, they cooperate, for example, with a roller cam follower of the respective gas exchange valve by abutting contact. As can be seen, the valve-actuating cams 8 shown here are eccentric, wherein the eccentricities are present at different angular positions or have different extents in the radial direction and/or circumferential direction. A corresponding stroke, opening time and/or duration of opening of a gas exchange valve thus arises depending on the valve-actuating cam 8 actuated by the gas exchange valve. Through axial displacement of the cam carrier 3, the gas exchange valve can be actuated by different valve-actuating cams 8. For example, the cam carrier 3 is displaced as a function of an operating state of the internal combustion engine, so that always the particular valve-actuating cam 8 cooperates with the gas exchange valve for its actuation that results, for example, in an optimum efficiency or optimum performance of the internal combustion engine.

The locking elements 9 provided at the ends of the cam carrier 3 are attached to the cam carrier 3 that that they are secured thereon in the axial direction. Preferably, the other cam elements 6 are simply plugged onto the basic element 4. They are thus held on the cam carrier 3 in the axial direction by the locking elements 9. A bearing shell 11 which is part of a camshaft bearing is arranged between two of the cam elements 6. The bearing shell 11, like the cam elements 6, is only plugged onto the basic element 4 and is held in the axial direction by the respective adjacent cam elements 6 and/or the locking elements 9. The bearing shell 11 is preferably integrally formed, i.e. undivided.

To also secure the cam elements 6 relative to the basic element 4 and the basic camshaft 2 in the circumferential direction, i.e. non-rotatably connecting the cam elements 6 thereto, at least one connecting element 12 is disposed between the basic element 4 and the cam elements 6. This connecting element 12 is designed to transmit torque, i.e. is non-rotatably connected to both the basic element and the cam elements 6.

Figure 2:
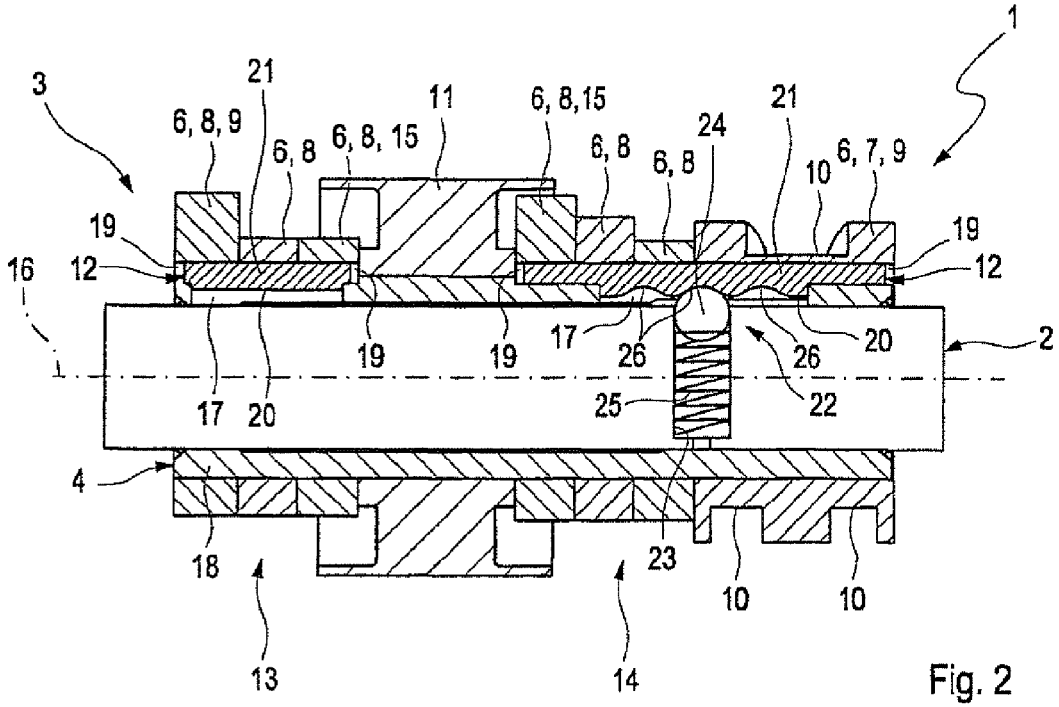

FIG. 2 is a side sectional view of a portion of the valve train 1. Here, the basic camshaft 2 is also shown on which the cam carrier 3 is arranged in a rotationally fixed and axially displaceable manner. As can be clearly seen, two groups of cams 13 and 14 are provided on the cam bracket 3. The first cam group 13 includes three valve-actuating cams 8, which are arranged on the left side of the cam carrier 3, while the three valve-actuating cams 8 arranged on the right side belong to the cam group 14. The cam elements 6 arranged directly adjacent to the bearing shell 11 may alternatively also be formed as spacers 15, which space the valve-actuating cams 8 of the cam groups 13 and 14 from the bearing shell 11 in the axial direction. The term axial direction is to be understood as a direction parallel to the longitudinal axis 16 of the basic camshaft 2.

As shown in the diagram of FIG. 2, two connecting elements 12 spaced apart in the axial direction are present. Alternatively, only a single connecting element 12 may be provided, or more than two connecting elements 12 may be disposed on the basic element 4. The connecting elements 12 engage with retaining openings 17 of the basic element 4. The retaining openings 17 pass here completely through a jacket 18 of the basic element 4 in the radial direction. The shape of the retaining openings 17 is matched to the respective connecting element 12 such that the connecting element 12 is form-fittingly held in the corresponding retaining opening 17 both in the circumferential direction and in the axial direction. Thus, the retaining openings 17 surround at least a portion of the respective connecting element 12 such that it is fixed in the circumferential direction and in the axial direction. Locating openings 19 of the cam elements 6 are provided on the side of the retaining opening 17 facing the connecting element 12. The connecting elements 12 also engage in the respective locating openings 19. The connecting elements 12 thus extend in the radial direction starting from the retaining openings 17 into the locating openings 19.

The locating openings 19 completely pass through the cam elements 6 in the axial direction, so that the cam elements 6 can be pushed onto the basic element 4 in spite of the connecting elements 12. The connecting elements 12 thus serve only to secure the cam elements 6 with respect to the basic element 4 in the circumferential direction. Preferably, the connecting elements 12 are each composed of a retaining portion 20 and a support portion 21. The retaining portion 20 resides substantially completely in the retaining opening 7, whereas the support portion 21 rests on the jacket 18 and the jacket surface, respectively, and at least partially engages in the respective locating opening 19. Thus, the connecting elements 12 are designed to transmit torque between the basic element 4 and the cam elements 6.

At least one of the connecting elements 12 also forms a retaining device 22 for axially securing the cam carrier 3 relative to the basic camshaft 2. The retaining device 22 is formed in the present case as a latching device, wherein a latching element 24—which is here spherical—is provided in a radial recess 23 of the basic camshaft 2. The latching element 24 is urged by a spring element 25 in the direction of the connecting element 12. The connecting element 12 has in the illustrated embodiment three recesses 26, in which the latching element 24 can latchingly engage. The illustrated valve train has three adjustable settings, meaning that the cam carrier 3 can be to be moved into three different axial positions with respect to the basic camshaft 2. In this manner, the cam carrier 3 can be displaced in the axial direction with respect to the basic camshaft 2, whereby the latching force of the retaining device 22 must be overcome during each move.

Figure 3:
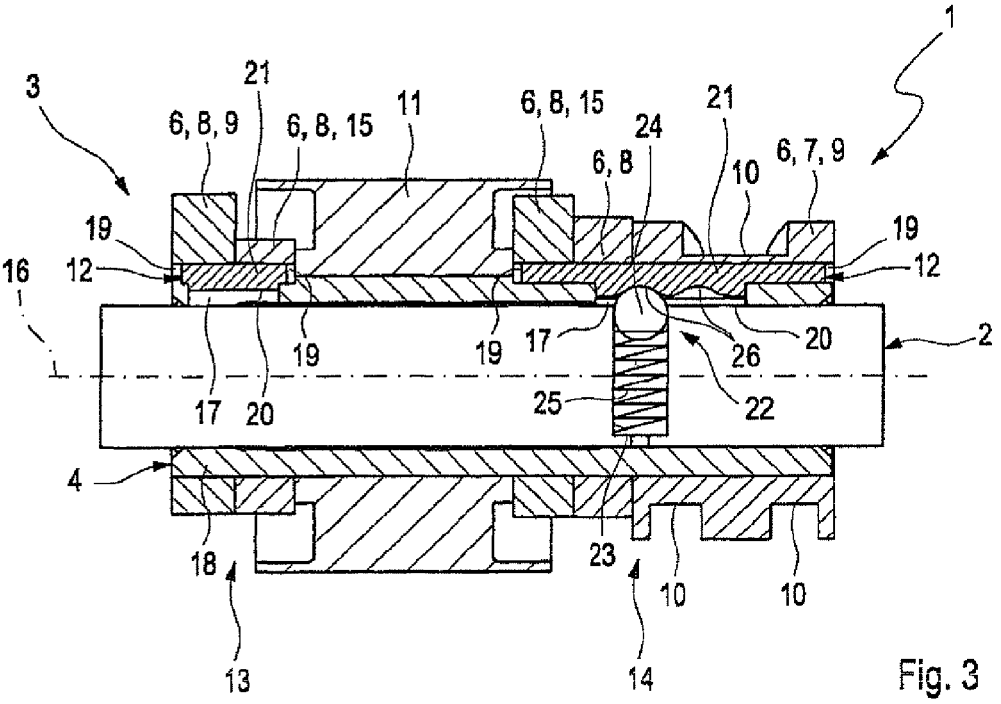

FIG. 3 shows another embodiment of the valve train 1, which substantially corresponds to the embodiment described with reference to FIG. 2, so that reference is made to the foregoing description. The difference is that the illustrated cam carrier 3 is adjustable only 2-fold, so that only two latching recesses 26 are provided on the connecting element 12. In addition, only two valve-actuating cams 8 are associated with each group of cams 13 and 14.

Figure 4:
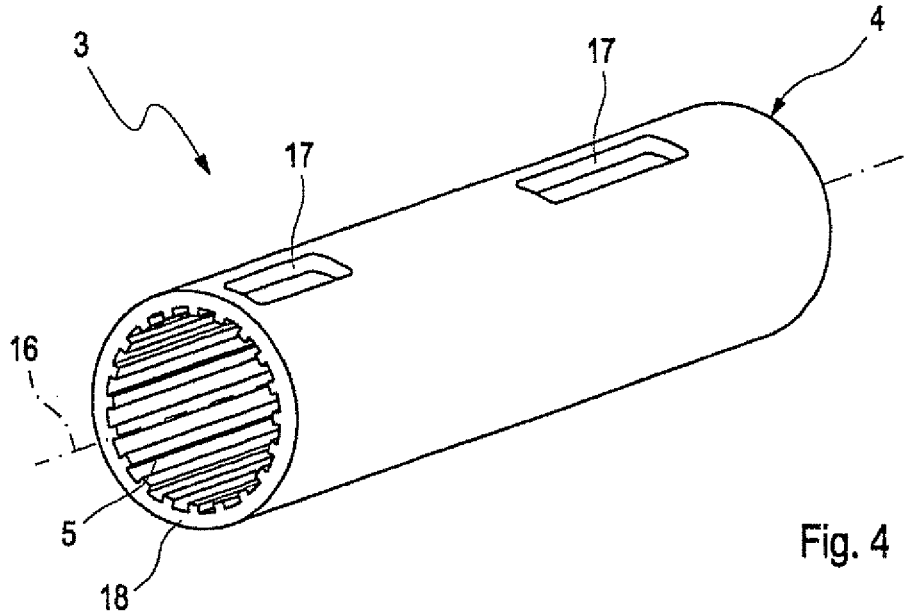

FIG. 4 shows the basic element 4 of the cam carrier 3. Clearly seen is here the internal toothing 5 for establishing the rotation-locked connection with the basic camshaft 2 (not shown). The retaining holes 17 are provided in the basic element 4, which are constructed as an oblong hole and extend here in the axial direction or have the greater extent in this direction.

Figure 5:
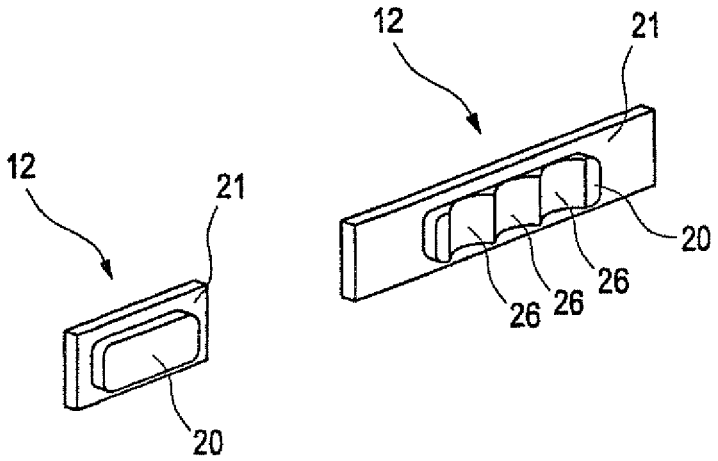

FIG. 5 shows the connecting elements 12, clearly showing that these are composed of the retaining portion 20 and the support portion 21. Furthermore, latching recesses 26 can be seen on the connecting element 12 on the right-hand side.

Figure 6:
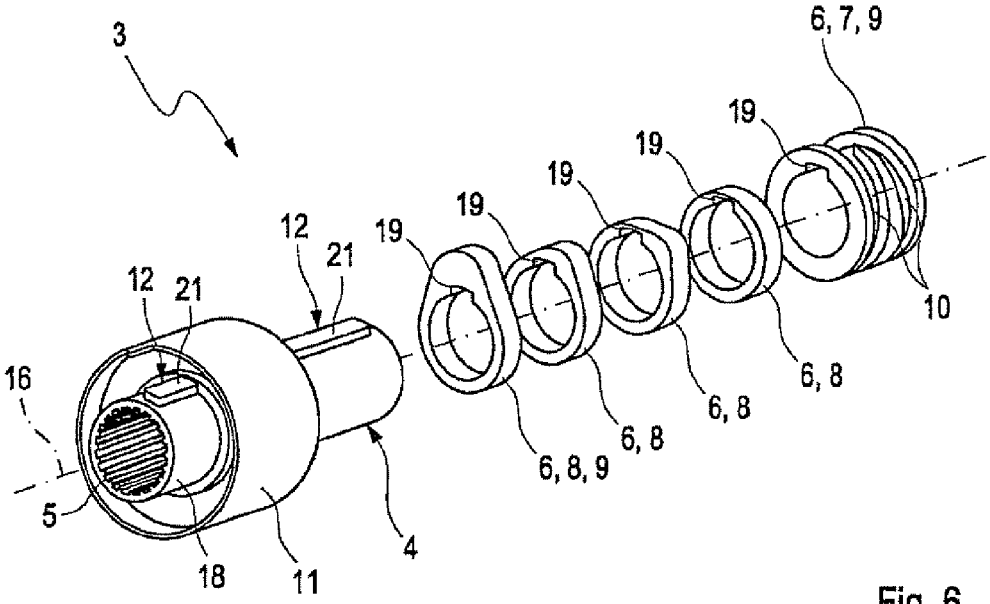

FIG. 6 shows an exploded view of the cam carrier 3 and the elements associated therewith, respectively. The connecting elements 12 are already arranged on the basic element 4. The bearing shell 11 is disposed between the two connecting elements 12 and fixed in the axial direction relative to the cam carrier 3 due to its arrangement between the two connecting elements 12. In addition to the basic element 4 and the bearing shell 11, four valve-actuating cams 8 and the shift gate 7 are shown.

The cam carriers 3 are usually assembled as follows: Initially, the bearing shell 11 is placed on the basic element 4. Then, the connecting elements 12 are placed on both sides of the bearing shell 11. Subsequently, two of the valve-actuating cams 8 to the left of the bearing shell 11 and two more of the operating cams 8 to the right of the bearing shell 11 are pushed onto the basic element 4 so that the locating openings 19 of the valve-actuating cams 8 enclose a portion of the connecting elements 12, in particular their support portion 21. The shift gate 7 is then also so applied onto the basic element 4 on the right side of the bearing shell 11, so that its locating opening 19 cooperates with the connecting element 12. Subsequently, the end-side cam elements 6, in this case one of the valve-actuating cams 8 and the shift gate 7, are secured in the axial direction on the basic element 4. In this way, the other cam elements 6 and the bearing cup 11 are also securely held in the axial direction.

Figure 7:
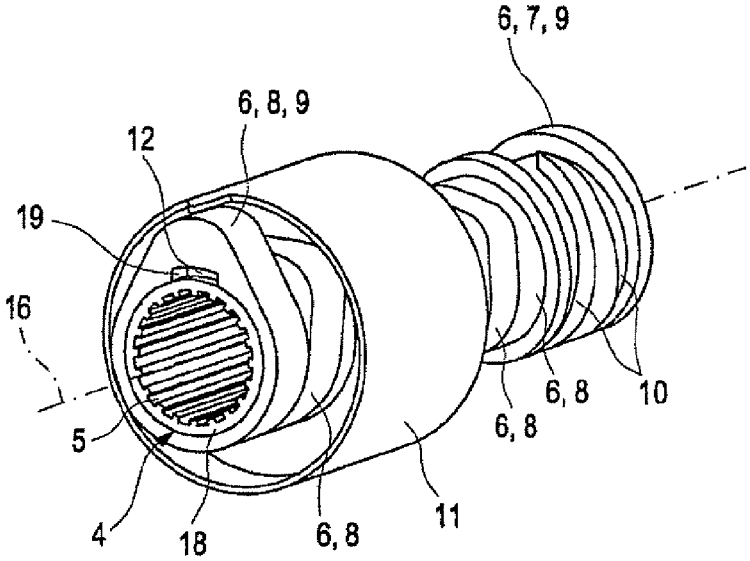

FIG. 7 shows the cam carrier 3 after assembly. The individual elements correspond to those described with reference to FIG. 6, so that reference is made to the foregoing description.

With the valve train 1 and the cam element 3 described above, a modular design is attained, which enables a simple and inexpensive manufacture of the cam carrier 3. In particular, the cam carrier 3 can be assembled in modular form so that different series of the valve train 1 can be composed of identical components.

The invention claimed is:

1. A valve train of an internal combustion engine, comprising:

at least one basic camshaft, a tubular basic element that at least partially surrounds the at least one basic camshaft and is arranged on the at least one basic camshaft in a rotationally fixed and axially displaceable manner, the tubular basic element comprising at least one retaining opening, and at least one torque-transmitting connecting element engaging at least partially in the at least one retaining opening of the tubular basic element and being form-fittingly held in the retaining opening at least in a circumferential direction, wherein the at least one torque-transmitting connecting element comprises a plurality of axially distributed latching recesses facing the at least one retaining opening of the tubular basic element, with the latching recesses configured to latch at different axial positions with a latching element disposed in a radial recess of the at least one basic camshaft, at least one valve-actuating cam comprising at least one cam element disposed around the tubular basic element and having an axially extending locating opening which extends completely through the at least one cam element in the axial direction and engages with at least a portion of the at least one torque-transmitting connecting element so as to allow the at least one cam element to be pushed onto the tubular basic element over the connecting elements in the axial direction.

2. The valve train of claim 1, wherein the at least one connecting element is form-fittingly held in the retaining opening additionally in an axial direction.

3. The valve train of claim 1, wherein the at least one connecting element is moveably in the locating opening in the axial direction.

4. The valve train of claim 1, comprising a plurality of individually constructed cam elements which are each secured in an axial direction through abutting contact with adjacent individually constructed cam elements.

5. The valve train of claim 1, wherein—as seen in a circumferential direction—the tubular basic element has only a single retaining opening or the cam element has only a single locating opening.

6. The valve train of claim 1, wherein the retaining opening completely passes through a wall the tubular basic element in a radial direction.

7. The valve train of claim 1, comprising a plurality of connecting elements which are spaced apart in an axial direction, and a camshaft bearing seated directly on the tubular basic element between each two of the connecting elements.

8. The valve train of claim 7, wherein the plurality of connecting elements is provided at an identical circumferential position.

9. The valve train of claim 7, wherein an undivided bearing shell of the camshaft bearing is seated directly on the tubular basic element between each two of the connecting elements.

10. The valve train of claim 7, wherein the camshaft bearing is held stationary in the axial direction by at least one of adjacent connecting elements and adjacent cam elements.

11. An internal combustion engine having at least one valve train, with the at least one valve train comprising:

at least one basic camshaft, a tubular basic element that at least partially surrounds the at least one basic camshaft and is arranged on the at least one basic camshaft in a rotationally fixed and axially displaceable manner, the tubular basic element comprising at least one retaining opening, and at least one torque-transmitting connecting element engaging at least partially in the at least one retaining opening of the tubular basic element and being form-fittingly held in the retaining opening at least in a circumferential direction, wherein the at least one torque-transmitting connecting element comprises a plurality of axially distributed latching recesses facing the at least one retaining opening of the tubular basic element, with the latching recesses configured to latch at different axial positions with a latching element disposed in a radial recess of the at least one basic camshaft, at least one valve-actuating cam comprising at least one cam element disposed around the tubular basic element and having a locating opening which extends completely through the at least one cam element in the axial direction and engages with at least a portion of the at least one torque-transmitting connecting element so as to allow the at least one cam element to be pushed onto the tubular basic element over the connecting elements in the axial direction.

12. A method for producing a valve train, comprising the steps of:

providing at least one basic camshaft, arranging a tubular basic element having at least one retaining opening on the at least one basic camshaft in a rotationally fixed and axially displaceable manner, inserting a torque-transmitting connecting element into the at least one retaining opening, the torque-transmitting connecting element comprising a plurality of axially distributed latching recesses facing the at least one retaining opening of the tubular basic element, with the latching recesses configured to latch at different axial positions with a latching element disposed in a radial recess of the at least one basic camshaft, pushing at least one cam element disposed around the tubular basic element and having a locating opening which extends completely through the at least one cam element in the axial direction and engages with at least a portion of the at least one torque-transmitting connecting element over the at least one torque-transmitting connecting element, and thereafter securing the axial position of the at least one cam element on the tubular basis element with at least one locking element.

13. The method of claim 12, wherein the at least one cam element comprises a valve-actuating cam.

* * * * *